US010562338B2

(12) United States Patent
Fourie

(10) Patent No.: US 10,562,338 B2
(45) Date of Patent: Feb. 18, 2020

(54) HEAT PEN FOR USE WITH ELECTRONIC CUTTING AND/OR DRAWING SYSTEMS

(71) Applicant: American Crafts, L.C., Lindon, UT (US)

(72) Inventor: Nicolas Stephans Fourie, Pretoria (ZA)

(73) Assignee: American Crafts, L.C., Lindon, UT (US)

( * ) Notice: Subject to any disclaimer, the term of this patent is extended or adjusted under 35 U.S.C. 154(b) by 0 days.

(21) Appl. No.: 16/244,031

(22) Filed: Jan. 9, 2019

(65) Prior Publication Data

US 2019/0389240 A1 Dec. 26, 2019

Related U.S. Application Data

(60) Provisional application No. 62/689,376, filed on Jun. 25, 2018, provisional application No. 62/787,379, filed on Jan. 1, 2019.

(51) Int. Cl.

| | |
|---|---|
| ***B44B 5/00*** | (2006.01) |
| ***B44B 7/00*** | (2006.01) |
| ***B43K 8/22*** | (2006.01) |

(52) U.S. Cl.

CPC ..... *B44B 7/00* (2013.01); *B43K 8/22* (2013.01); *B44B 5/008* (2013.01); *B44B 2700/08* (2013.01)

(58) Field of Classification Search

CPC .. B43K 8/22; B44B 7/00; B44B 5/008; B44B 2700/08

USPC ..... 219/69.12, 69.13, 69.17, 69.2, 69.15; 250/202

See application file for complete search history.

(56) References Cited

U.S. PATENT DOCUMENTS

| | | | | |
|---|---|---|---|---|
| 450,197 A * | 4/1891 | Shattuck | ..... | B43K 5/18 401/224 |
| 1,190,447 A * | 7/1916 | Munger | ..... | B23K 3/0315 219/233 |
| 1,550,048 A * | 8/1925 | Ruben | ..... | B43K 8/22 178/62 |

(Continued)

FOREIGN PATENT DOCUMENTS

| | | |
|---|---|---|
| CN | 104404734 | 3/2015 |
| CN | 105291671 | 2/2016 |

(Continued)

OTHER PUBLICATIONS

USPTO as International Searching Authority, "International Search Report and Written Opinion," International application No. PCT/US2019/012945, dated Mar. 27, 2019.

*Primary Examiner* — Jimmy Chou

(74) *Attorney, Agent, or Firm* — Durham Jones & Pinegar, P.C., Intellectual Property Law Group

(57) ABSTRACT

A heat pen may be used with an electronic cutting and/or drawing system to enable the electronic cutting and/or drawing system to use heat to define text and/or designs on a substrate. The heat pen may be coupled with a cradle of an electronic cutting and/or drawing system directly or by assembling an adapter with the heat pen. Power may be supplied to the heat pen by electrically coupling the heat pen to an external power supply, such as a power and/or communications port of the electronic cutting and/or drawing system. Electronic heated design systems and methods for modifying substrates using heat are also disclosed.

15 Claims, 3 Drawing Sheets

(56) References Cited

U.S. PATENT DOCUMENTS 1,865,610 A * 7/1932 Blair ..... B43K 8/22 101/26
2,031,532 A * 2/1936 Goldman ..... H05B 3/02 219/239
2,033,897 A * 3/1936 Jenkins ..... H05B 3/02 101/31
2,173,741 A * 9/1939 Wise ..... B43K 8/22 101/DIG. 37
2,185,266 A * 1/1940 Raffles ..... H05B 3/02 219/239
2,454,576 A * 11/1948 Slack ..... A61C 13/0028 219/237
2,487,340 A * 11/1949 Kleinsmith ..... B43K 1/08 401/209
2,488,477 A * 11/1949 Rapaport ..... H05B 3/02 219/227
2,494,412 A * 1/1950 Simkins ..... B43K 8/22 219/229
2,577,721 A * 12/1951 Belak ..... B43K 8/22 219/230
2,598,900 A * 6/1952 Frye ..... B29C 65/18 219/237
3,169,821 A * 2/1965 Miller ..... B43L 13/00 346/113
3,235,706 A * 2/1966 Neumann ..... B05C 17/0053 219/227
3,399,121 A * 8/1968 Klein ..... B41M 5/20 205/53
3,558,854 A * 1/1971 Siegel ..... B23K 3/0315 219/233
3,673,372 A * 6/1972 Veroman ..... B23H 1/00 219/69.2
3,691,901 A 9/1972 Shelton
3,781,907 A * 12/1973 Gerber ..... B43K 8/18 346/140.1
3,800,122 A * 3/1974 Farmer ..... A61C 13/0028 219/239
3,811,030 A * 5/1974 Veach ..... B43K 8/22 219/237
3,876,857 A * 4/1975 Dhillon ..... B23K 3/03 219/230
3,886,311 A * 5/1975 Rodgers ..... G06F 3/044 178/20.04
3,969,606 A * 7/1976 Veach ..... B43K 8/22 219/237
4,050,075 A * 9/1977 Hertz ..... G01D 9/38 347/73
4,056,136 A 11/1977 Miller
4,176,273 A * 11/1979 Fujie ..... B29C 65/18 219/220
4,218,152 A * 8/1980 Sloan ..... B43K 8/22 401/2
4,254,520 A * 3/1981 Saurman ..... B44D 2/002 206/503
4,292,641 A * 9/1981 Grassmann ..... G01D 15/10 346/139 C
4,321,682 A * 3/1982 Koshikawa ..... G06K 11/02 250/202
4,441,020 A * 4/1984 Sakamoto ..... B23Q 35/128 250/202
4,525,214 A * 6/1985 Panken ..... G09B 11/04 106/170.22
4,549,243 A * 10/1985 Owen ..... B05B 5/0255 239/690
4,594,499 A 6/1986 Rapsey et al.
4,758,846 A * 7/1988 Watkins ..... G01D 15/10 219/237
4,798,934 A * 1/1989 Boyer ..... B23K 3/0346 16/431
4,983,802 A * 1/1991 Kobayashi ..... B23H 7/06 219/69.12
5,211,495 A * 5/1993 Jozat ..... B43K 5/189 401/195
5,433,642 A * 7/1995 Chia ..... B43K 8/22 401/195
5,448,269 A * 9/1995 Beauchamp ..... B41J 2/04505 347/14
5,459,298 A * 10/1995 Tschakaloff ..... A61B 17/8085 219/221
5,502,967 A * 4/1996 Nakagawa ..... B43K 8/22 219/216
5,551,319 A * 9/1996 Spaulding ..... A01K 11/005 30/362
5,933,970 A * 8/1999 Diresta ..... B43K 8/22 33/18.1
6,119,567 A 9/2000 Schindler et al.
6,454,482 B1 * 9/2002 Silverbrook ..... B41J 2/17503 346/140.1
6,576,183 B1 * 6/2003 Thomas ..... B23K 7/105 266/64
6,662,976 B2 * 12/2003 Jensen ..... B67D 3/0003 222/481.5
6,663,308 B1 * 12/2003 Michelizzi ..... B43K 23/02 219/201
6,709,180 B2 * 3/2004 Cochran ..... A45D 26/0014 219/201
7,977,597 B2 * 7/2011 Roberts ..... B23K 20/005 219/56.22
8,715,468 B2 * 5/2014 Cabrera ..... B23H 3/04 204/224 M
8,921,746 B2 * 12/2014 Baarman ..... A45D 40/261 219/660
9,649,775 B2 * 5/2017 Kumazawa ..... B23K 26/0093
2002/0092396 A1 7/2002 Hsiao
2005/0013926 A1 * 1/2005 Rutkowski ..... B05C 5/0216 427/8
2007/0235416 A1 * 10/2007 Krug ..... B26F 1/0015 219/69.12
2007/0286665 A1 * 12/2007 Bouix ..... A45D 40/267 401/1
2009/0289055 A1 * 11/2009 Baarman ..... A45D 40/261 219/660
2011/0169756 A1 * 7/2011 Ogawa ..... G06F 3/03545 345/173
2011/0200381 A1 * 8/2011 Bylsma ..... A45D 34/04 401/118
2013/0321422 A1 * 12/2013 Pahwa ..... G06T 11/203 345/428
2015/0253879 A1 * 9/2015 Kawai ..... G06F 3/03545 345/179

FOREIGN PATENT DOCUMENTS

EP 0952008 A2 * 10/1999 ..... B21C 51/00
JP H11216998 8/1999
JP 2005313465 * 11/2005 ..... B44B 5/00
JP 2008279664 11/2008

* cited by examiner

HEAT PEN FOR USE WITH ELECTRONIC CUTTING AND/OR DRAWING SYSTEMS

CROSS-REFERENCE TO RELATED APPLICATION

Claims for priority to the Jan. 1, 2019 filing date of U.S. Provisional Patent Application No. 62/787,379, titled HEAT PEN FOR USE WITH ELECTRONIC CUTTING AND/OR DRAWING SYSTEMS ("the '379 Provisional Application") and to the Jun. 25, 2018 filing date of U.S. Provisional Patent Application No. 62/689,376, titled HEAT PEN FOR USE WITH ELECTRONIC CUTTING AND/OR DRAWING SYSTEMS ("the '376 Provisional Application") are hereby made pursuant to 35 U.S.C. § 119(e). The entire disclosures of the '379 Provisional Application and the '376 Provisional Application are hereby incorporated herein.

TECHNICAL FIELD

This disclosure relates generally to tools that may be used with electronic cutting and/or drawing systems and, more specifically, to a heat pen that may be used with an electronic cutting and/or drawing system.

DISCLOSURE

A heat pen according to this disclosure has a configuration that enables it to be used in place of a blade and/or a pen of an electronic cutting and/or drawing system. Accordingly, such a heat pen may also be referred to as an "insert." A heat pen, or insert, may include a housing, a heating element, and a power supply.

The housing of the heat pen, or insert, may have a configuration that enables it to be received by a cradle of one or more types of electronic cutting and/or drawing systems. In some embodiments, the housing of the heat pen may have dimensions that enable it to be received by and, optionally, coupled to cradles of a plurality of different types of electronic cutting and/or drawing systems, either alone or with an adapter. More specifically, the housing, along with any adapter that has been assembled therewith, may have a configuration that, when the heat pen is assembled with the cradle of an electronic cutting and/or drawing system, enables a bottom of the housing to face a support mat and any substrate positioned on the support mat. Without limitation, the housing may have an elongated configuration.

The housing of the heat pen carries the heating element of the heat pen. The heating element may be carried in such a way that a tip of the heating element protrudes beyond the bottom of the housing of the heat pen. The tip may have a configuration that enables it to be used for one or more intended purposes. As an example, the tip may be flat or somewhat rounded. A flat or rounded tip may be useful for laminating one type of media (e.g., a reactive foil, such as a heat-activated foil, etc.) to a sheet of another type of media (e.g., paper, cardstock, etc.). As another example, the tip may be pointed or beveled. A pointed or beveled tip may be useful for wood burning.

A remainder of the heating element of the heat pen may have a configuration that enables the tip to be heated. The remainder of the heating element, along with any thermally insulating components or features that surround the heating element, may be located within the housing of the heat pen.

The power supply of the heat pen provides sufficient power to the heating element to enable the heating element to be heated to a temperature sufficient to enable the tip of the heating element to perform a desired function (e.g., laminate reactive foil onto a sheet of media, burn wood, etc.). The power supply may be at least partially carried by (e.g., within, etc.) the housing of the heat pen. In some embodiments, the power supply may comprise a power cable that has been coupled to the heating element at a location within the housing, that extends from a top of the housing, and that may be capable of electrically coupling the heating element to an external power supply, such as an electrical outlet, a powered communications port (e.g., a universal serial bus (USB) type port, etc.) of the electronic cutting and/or drawing system, and/or a powered communications port of a computer. Alternatively, the power supply may comprise a rechargeable battery, which may be recharged with a removable power cable (e.g., a USB cable, etc.). In some embodiments, a switch (e.g., a manual electrical switch, and automatic shutoff, etc.) may control the flow of electricity to the heating element.

Optionally, one or more adapters may be provided with the heat pen. Each adapter may be capable of assembly with the housing of the heat pen in a manner that enables the heat pen to be properly assembled with and secured to the cradle of a particular, corresponding electronic cutting and/or drawing system. Such an adapter may include a receptacle with a configuration complementary to a configuration of an exterior surface of at least a portion of the housing of the heat pen. An exterior surface of the adapter may have a configuration complementary to a configuration of at least a portion of a receptacle of the cradle of the corresponding electronic cutting and/or drawing system; thus, the adapter may enable the heat pen to fit securely within the receptacle of the cradle. In some embodiments, each adapter may be capable of sliding onto and off of the housing the heat pen. In other embodiments, each adapter may be mechanically secured into place on the housing of the heat pen (e.g., by way of complementary threading, a complementary locking mechanism, a snap fit, etc.).

In another aspect, electronic heated design systems that are capable of selectively heating substrates to decoratively modify the substrate are disclosed. Such an electronic heated design system may comprise an electronic cutting and/or drawing system, such as a CRICUT® electronic cutting and/or drawing system available from Provo Craft and Novelty, Inc., of South Jordan, Utah, or a CAMEO® electronic cutting and/or drawing system available from Silhouette America, Inc., of Lindon, Utah. The electronic heated design system may include a support mat, a heating element, a carriage, a cradle, a processor, and memory. The support mat may be capable of receiving and supporting a substrate. The heating element, which may comprise a heat pen of this disclosure, includes a tip capable of being positioned against the substrate and of applying heat to the substrate. The carriage and the cradle may be capable of positioning the tip of the heating element against the substrate, and in moving the tip to selected locations over the substrate. The memory may store instructions for controlling operation of the carriage (i.e., its movement of the cradle and the tip of the heating element), and the processor may access those instructions from the memory and execute them to control operation of the carriage and, thus, movement of the tip of the heating element in a desired manner (e.g., in accordance with a program that corresponds to one or more predetermined characters (e.g., letters, numbers, symbols, etc.), patterns, and/or designs; etc.).

A variety of different substrates may be used with such an electronic heated design system. As an example, when the electronic heated design system is used to laminate one material (e.g., reactive foil, etc.) to a sheet of media, the substrate may comprise the sheet of media and a sheet of the reactive foil superimposed over the sheet of media. Alternatively, the substrate may comprise a sheet of a thermally sensitive medium, which may undergo a change in appearance (e.g., color, texture, etc.) when heated to one or more threshold temperatures. As another alternative, the substrate may comprise a sheet of material into which characters, patterns, and/or designs may be melted, etched, burned, etc. (e.g., a thermoplastic film, wood, parchment, etc.).

According to another aspect, a method for decoratively altering a substrate includes securing the substrate to a support mat. The substrate may include a sheet of media and, optionally, a sheet of a material (e.g., reactive foil, etc.) that is to be laminated onto the sheet of media. With the substrate in place, the support mat may be placed beneath a carriage of an electronic cutting and/or drawing system. In addition, a heat pen may be secured to a cradle carried by a carriage of the electronic cutting and/or drawing system. The heating element of the heat pen may be heated to an appropriate temperature by supplying power to the heating element (e.g., by plugging a power cable that has been electrically coupled to the heating element into a power source, by moving a switch to an "on" position, etc.). The carriage of the electronic cutting and/or drawing system may then be operated. Operation of the carriage may include bringing a tip of a heating element of the heat pen into contact with the substrate and moving the carriage and, thus, the heat pen, its heating element, and the tip of the heating element over the substrate to decoratively alter the substrate in a desired manner (e.g., with characters, patterns, and/or designs; etc.). In some embodiments, the substrate may also be cut and/or drawn on with a blade and/or pen, respectively, of the electronic cutting and/or drawing system. Once the substrate has been decoratively altered, the support mat may be removed from beneath the carriage, and the substrate may be removed from the support mat.

Other aspects of the disclosed subject matter, as well as features and advantages of the disclosed subject matter, should be apparent to those of ordinary skill in the art through consideration of the foregoing disclosure, the ensuing description and image, and the appended claims.

DETAILED DESCRIPTION

Figure 1:
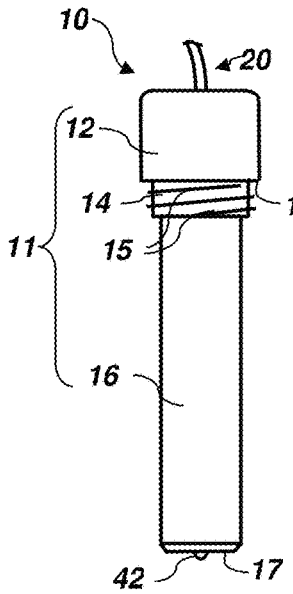
FIG. 1 illustrates an embodiment of a heat pen according to this disclosure.
Figure 2:
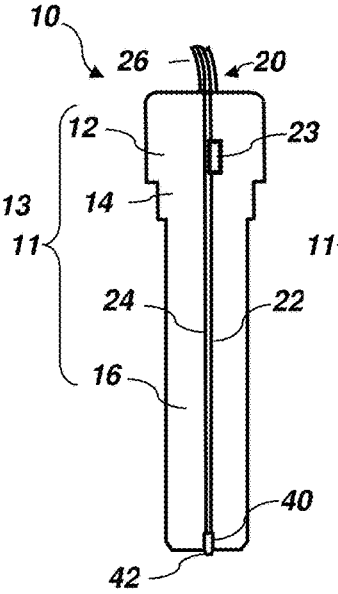
FIG. 2 is a cross-sectional representation of the embodiment of heat pen shown in FIG. 1.

FIGS. 1 and 2 illustrate an embodiment of a heat pen 10. The heat pen 10 includes a housing 11, a power supply 20, and a heating element 40. The housing 11, which may comprise a thermal insulator, carries the power supply 20 and the heating element 40.

The housing 11 of the heat pen 10 may include a head 12, a neck 14, and a body 16. The head 12 of the housing 11, or the top of the housing 11, may have a configuration that enables it to be held by an individual. In some embodiments, the head 12 may be enlarged relative to (e.g., have a larger diameter than, etc.), the neck 14 of the housing 11 and the body 16 of the housing 11. A lower edge 13 of the head 12 may be laterally exposed beyond an outer periphery of the neck 14. As illustrated, the head 12 may be cylindrical in shape, with rounded edges between its circumference and its upper surface.

The neck 14 of the housing 11, which may also be referred to as an intermediate portion of the housing 11, may be immediately adjacent to the head 12 of the housing 11. The neck 14 may include one or more engagement features 15, such as the illustrated helical thread, that enable the neck 14 to engage complementary engagement features 57 (FIGS. 4A-4D) of an adapter 50, 50', 50", 50'" (FIGS. 4A-4D), as will be described in further detail hereinafter. The neck 14 may have a cylindrical shape.

The body 16 of the housing 11, which comprises a bottom of the housing 11, is located on an opposite side of the neck 14 of the housing 11 from the head 12. The body 16 may have a configuration that enables it to be received by and, optionally, engaged by a cradle 102 (FIGS. 7-10) of an electronic cutting and/or drawing system 100 (FIG. 10). The configuration of the body 16 may enable it to receive or to be received by any of a plurality of different adapters 50, 50', 50", 50'" (FIGS. 4A-4D), which may enable the heat pen 10 to be assembled with a variety of different electronic cutting and/or drawing systems 100. Additionally, a lower portion of the body 16 may have a configuration that enables the lower portion to protrude from a lower portion of the cradle 102 with which the heat pen 10 and an optional adapter 50, 50', 50", 50'" are assembled. In the embodiment depicted by FIG. 1, the body 16 of the housing 11 of the heat pen 10 is cylindrical in shape.

The body 16 of the housing 11 may carry the heating element 40 of the heat pen 10, with a tip 42 of the heating element 40 protruding beyond a bottom surface 17 of the body 16.

As illustrated by FIGS. 1 and 2, the power supply 20 of the heat pen 10 may comprise a power cable 26 that may communicate with an external power source 104 (FIG. 8), such as a powered port of an electronic cutting and/or drawing system 100 (FIG. 10) (e.g., a universal serial bus (USB) port, etc.), an electrical outlet, or the like. The power supply 20 may include a plurality of wires 22 and 24 that establish an electrical circuit between the external power source 104 and electronics of the heat pen 10. In particular, the wires 22 and 24 of the power supply 20 may establish an electrical circuit between the external power source 104 and the heating element 40 of the heat pen 10.

The heating element 40 of the heat pen 10 may comprise a resistor, which may generate heat as an electrical current flows through the circuit defined by the external power source 104 (FIG. 8), the wires 22 and 24, and the heating element 40. The resistor of the heating element 40 may be configured to heat the heating element 40 as an electrical current flows through the circuit. The temperature to which the heating element 40 is heated may depend upon the current supplied by the external power source 40. As is known in the art, USB 1.0 and USB 2.0 ports are capable of generating a current of up to about 500 mA (0.5 A), USB 3.0 ports are capable of generating a current of up to about 900 mA, and dedicated charging ports can generate a current of up to about 1,500 mA (1.5 A).

Figure 10:
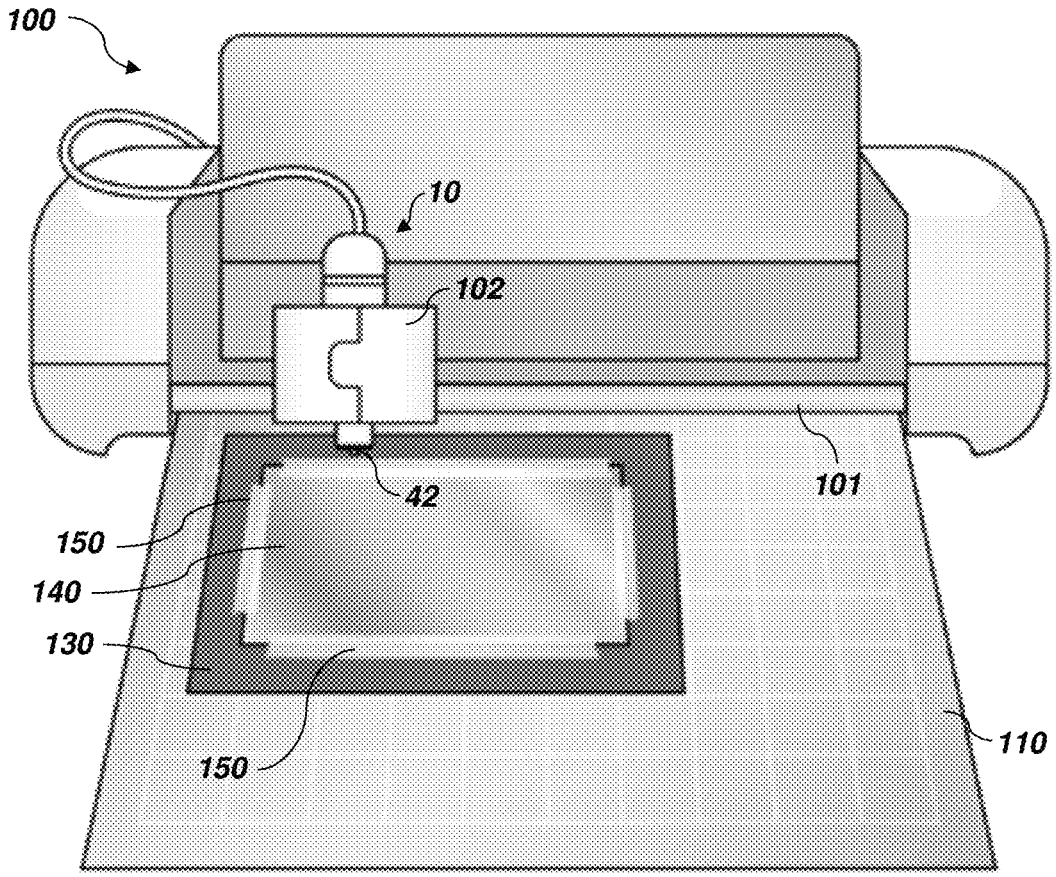
FIG. 10 illustrates an embodiment of a manner in which a heat pen according to this disclosure may be used with an electronic cutting and/or drawing system to modify a sheet of a medium.
Figure 11:
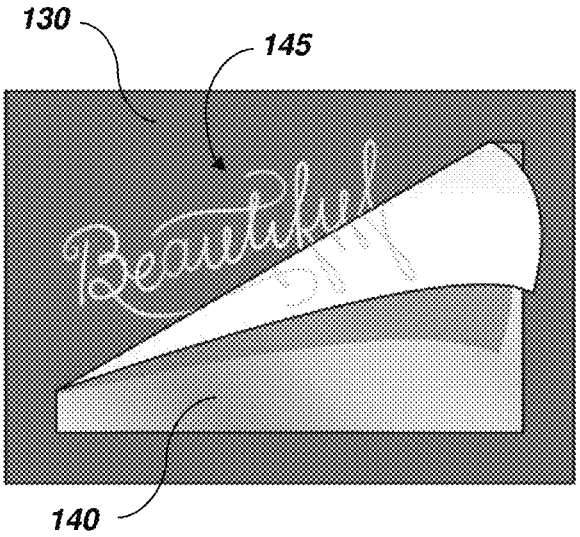
FIG. 11 shows an embodiment of a sheet of a medium that has been modified with a heat pen and an electronic cutting and/or drawing system, such as those depicted by FIG. 10.

An exterior of at least a portion of the heating element 40 may be capable of conducting heat generated by the resistor of the heating element 40. In the illustrated embodiment, the heating element 40 includes a tip 42 capable of conducting heat generated by the resistor to objects with which the tip 42 is brought into contact. A distance across the tip 42 may define a distance across a feature, such as a diameter of a dot or a thickness of a line, that may be defined by the tip 42 as the tip 42 is heated and brought into contact with an objection, such as a sheet 140 (FIGS. 10 and 11) of a heat-sensitive medium. The heat pen 10 may have a fine tip (e.g., a diameter of up to about 0.8 mm), a standard tip (e.g., a diameter of about 0.9 mm to about 1.3 mm, etc.), or a bold tip (e.g., a diameter of about 1.4 mm or greater). A shape of the tip 42 may at least partially define a shape of a feature that may be defined by the tip 42 as it is heated and brought into contact with an object.

Additionally, an outer periphery of the heating element 40 may comprise and/or be surrounded by a thermal insulator, which may prevent heat generated by the resistor of the heating element 40 from being communicated to the body 16 of the housing 11, or at least limit the transfer of heat from the heating element 40 to the body 16.

In some embodiments, the electrical circuit of a heat pen 10 may include one or more accessories 23 in addition to the wires 22 and 24 and the resistor of the heating element 40. Without limitation, such an accessory 23 may comprise a switch, an auto-shutoff device, a temperature control device, or any combination of the foregoing.

Figure 3:
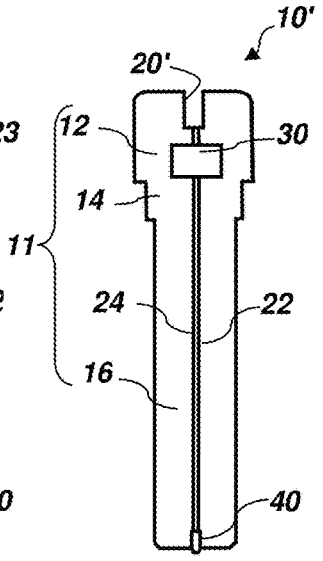
FIG. 3 is a cross-sectional representation of another embodiment of heat pen according to this disclosure.

In FIG. 3 another embodiment of heat pen 10' is shown and described. While the housing 11, including the head 12, neck 14, and body 16, of heat pen 10' are similar to or the same as the corresponding features of the housing 11 of the embodiment of heat pen 10 shown in FIGS. 1 and 2, the electronics of heat pen 10' differ somewhat from the electronics of heat pen 10. In particular, heat pen 10' includes an internal power source 30, such as a battery. In addition, the heat pen 10' includes a charging port 20' (e.g., a USB port, etc.). The charging port 20' communicates with the internal power source 30 in a manner that enables the internal power source 30 to communicate with an external power source (e.g., a USB port, an electrical outlet, a battery, etc.) to enable charging of the internal power source 30. Like the embodiment of heat pen 10 shown in FIGS. 1 and 2, heat pen 10' includes wires 22 and 24 that establish an electrical circuit between the internal power source 30 and a heating element 40 of the heat pen 10'.

Turning now to FIGS. 4A-4D, various embodiments of adapters 50, 50', 50", 50'", respectively, are depicted. Each adapter 50, 50', 50", 50'" includes a body 52, 52', 52", 52'" through which a receptacle 54, 54', 54", 54'" extends. The receptacle 54, 54', 54", 54'" may have a shape and dimensions that enable it to receive and slide along a length (or height) of the body 16 (FIGS. 1-3) of a heat pen 10 (FIGS. 1 and 2), 10' (FIG. 3). In embodiments where the body 16 is cylindrical, the receptacle 54, 54', 54", 54'" may comprise a cylindrical channel extending through the body 52, 52', 52", 52'" of the adapter 50, 50', 50", 50'". At its top end 56, 56', 56", 56'", a periphery of the receptacle 54, 54', 54", 54'" may include or define one or more engagement features 57, 57', 57", 57'", which may have a configuration capable of engaging, being engaged by, or mutually engaging the one or more engagement features 15 of the neck 14 of the housing 11 of the heat pen 10, 10'(FIGS. 1-3). In the illustrated embodiment, the engagement features 57, 57', 57", 57'" comprise helical threads that may complement the thread of the embodiment of engagement feature 15 shown in FIGS. 1-3. Of course, other types of engagement features may be used in place of helical threads, such as complementary surfaces that establish an interference fit, snap-fitting features, interlocking features, and the like.

An exterior of the body 52, 52', 52", 52'" of each adapter 50, 50', 50", 50'" may have a configuration that enables the adapter 50, 50', 50", 50'" and a heat pen 10, 10' with which the adapter 50, 50', 50", 50'" is assembled to be coupled with a cradle 102 (FIGS. 7-10) of an electronic cutting and/or drawing system 100 (FIG. 10). The configuration of the exterior of the body 52, 52', 52", 52'" of the adapter 50, 50', 50", 50'" may complement a shape of a receptacle of a cradle 102 of an electronic cutting and/or drawing system 100 with which the adapter 50, 50', 50", 50'" is capable of use, which may enable the adapter 50, 50', 50", 50'" to be received and stably held by the receptacle of the cradle 102.

Figure 4A:
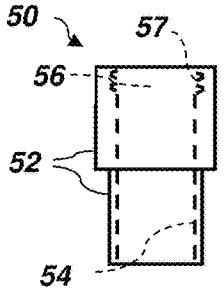
FIGS. 4A-4D illustrate various embodiments of adapters capable of use with a heat pen according to this disclosure, with each embodiment of adapter having a configuration that enables it to adapt a heat pen for use with a cradle of a particular, corresponding type of electronic cutting and/or drawing system.
Figure 4B:
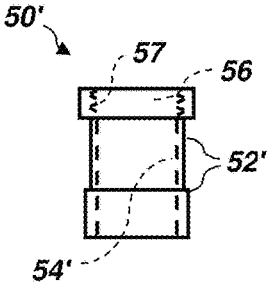
Figure 4C:
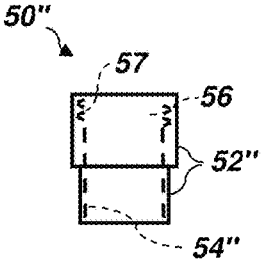
Figure 4D:
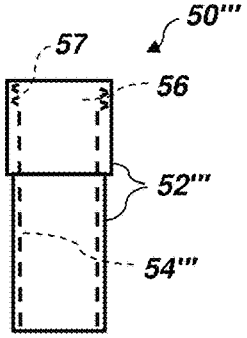

The body 52 of the adapter 50 shown in FIG. 4A has a configuration that enables a heat pen 10 (FIGS. 1 and 2), 10' (FIG. 3) to be coupled with the cradle 102 (FIGS. 7-10) of a SILHOUETTE electronic cutting and/or drawing system 100 (FIG. 10) (available from Silhouette America, Inc., of Lindon, Utah). FIG. 4B illustrates an embodiment of adapter 50' with a configuration that enables coupling of a heat pen 10, 10' to a cradle 102 of a BROTHER electronic cutting and/or drawing system 100 (available from Brother International Corporation of Bridgewater, N.J.). FIG. 4C depicts an embodiment of adapter 50" capable of assembly with a heat pen 10, 10' in a manner that enables the heat pen 10, 10' to be coupled with a cradle 102 of a CRICUT electronic cutting and/or drawing system 100 (available from Provo Craft & Novelty, Inc., of South Jordan, Utah). The embodiment of adapter 50'" shown in FIG. 4D can be assembled with a heat pen 10, 10' to enable the heat pen 10, 10' to couple to a cradle 102 of a SIZZIX electronic cutting and/or drawing system 100 (available from Ellison Educational Equipment of Lake Forest, Calif.).

Figure 5:
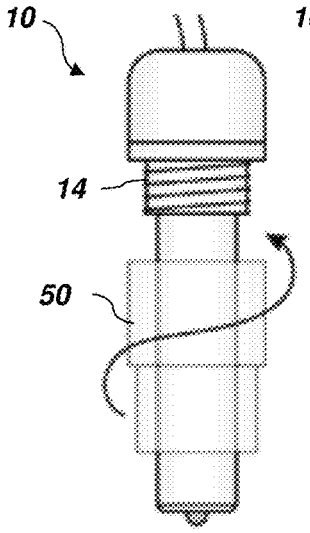
FIG. 5 provides a representation of an embodiment of a manner in which an adapter (e.g., the embodiment of adapter shown in FIG. 4A) may be secured to a heat pen (e.g., the embodiment of heat pen shown in FIG. 1)
Figure 6:
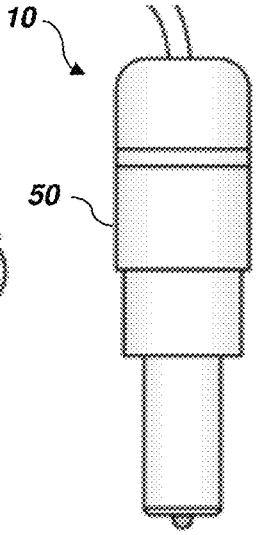
FIG. 6 illustrates an embodiment of a heat pen with an embodiment of an adapter secured thereto.

As illustrated by FIG. 5, the body 16 of the housing 11 (FIGS. 1 and 2) of a heat pen 10 may introduced into the top end 56 (FIG. 4A) of the receptacle 52 (FIG. 4A) of an adapter 50 until the top end 56 reaches the neck 14 of the housing 11. Upon introducing the neck 14 of the housing 11 of the heat pen 10 into the top end 56 of the receptacle 52 of the adapter 50, engagement features 15, 57 (FIGS. 4A-4D) of one or both of the neck 14 and the top end 56 may couple the adapter 50 to the heat pen 10. In the embodiment depicted by FIG. 5, the neck 14 of the housing 11 of the heat pen 10 and the top end 56 of the receptacle 52 of the adapter 50 may include complementary helical threads, which may engage one another as one or both of the adapter 50 and the heat pen 10 is rotated relative to the other of these apparatuses. FIG. 6 shows the adapter 50 assembled with the heat pen 10.

Figure 9:
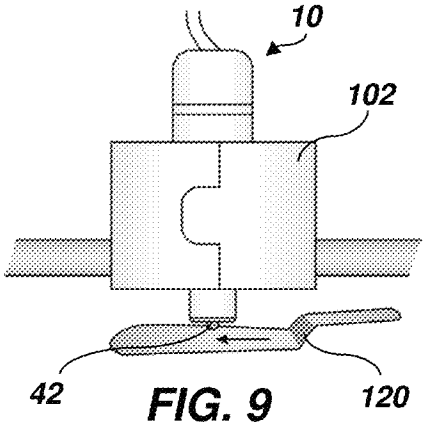
FIG. 9 depicts placement of a protective shield over the tip of the heat pen to limit contact with the tip as it is heated.
Figure 8:
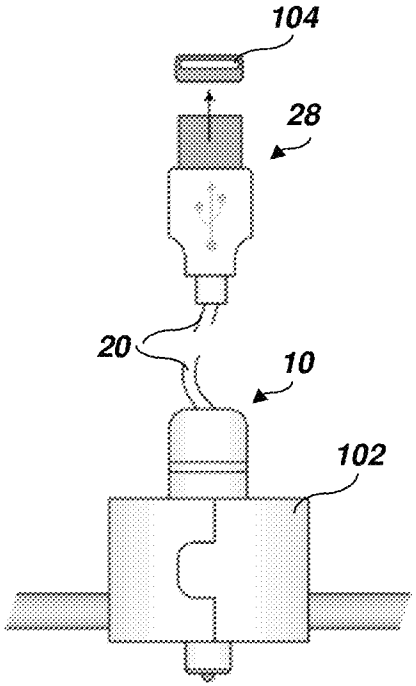
FIG. 8 shows the heat pen-adapter assembly of FIG. 6 assembled with the cradle of the electronic cutting and/or drawing system, and illustrates connection of the heat pen to an external power source.
Figure 7:
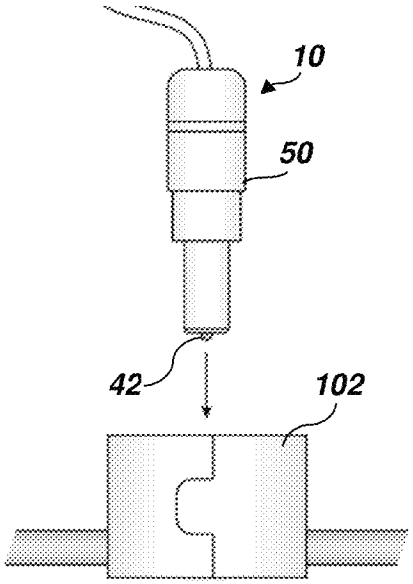
FIG. 7 depicts an embodiment of assembly of the embodiment of heat pen-adapter assembly of FIG. 6 with a cradle of an electronic cutting and/or drawing system.

Turning next to FIGS. 7-9, an embodiment of a manner in which a heat pen 10 may be assembled with the cradle 102 of an electronic cutting and/or drawing system 100 (FIG. 10) is depicted. Without limitation, the heat pen 10 may be assembled with a cradle 102 that is configured to receive, carry, and move a cutting blade or a cradle 102 that is configured to receive, carry, and move a writing and/or drawing instrument. In FIG. 7, the tip 42 of the heating element 40 (FIG. 2) of the heat pen 10 is oriented toward the cradle 102, and the heat pen 10 and any adapter 50 assembled therewith are coupled to the cradle 102 (e.g. by introduction thereof into a receptacle of the cradle 102, etc.). FIG. 8 illustrates coupling of a coupling element 28 (e.g., a USB connector, etc.) of the power supply 20 of the heat pen 10 to a power source 104, such as a powered port (e.g., a USB port, etc.) of the electronic cutting and/or drawing system 100. In some embodiments, such as that depicted by FIG. 9, a protective cover 120 may be placed over the tip 42 of the heating element 40 while the heating element 40 is heated but not in use to prevent inadvertent contact with the tip 42 of the heating element 40 and, thus, any damage that might result from inadvertent contact with the tip 42.

FIG. 10 depicts an embodiment of an electronic heated design system, which may include an electronic cutting and/or drawing system 100 and a heat pen 10 according to this disclosure. Alternatively, an electronic heated design system may include a carriage 101 capable of moving a tip of an integrated heating element into contact with and over selected locations of a substrate.

As illustrated by FIG. 10, a substrate 130, 140 that is to be modified by use of a heat pen 10 may be positioned on a support mat 110 capable of use with an electronic cutting and/or drawing system 100. Once the substrate 130, 140 has been positioned on the support mat 110, it may be secured to the support mat 110. In the specific embodiment depicted by FIG. 10, substrate 130 may comprise a sheet of a substrate medium (e.g., paper, cardstock, bookboard, vinyl, acetate, vellum, fabric, leather, wood, etc.) to which a laminating medium (e.g., a heat-activated foil, etc.) is to be laminated, and substrate 140 may comprise a sheet of the laminating medium or a sheet that carries the laminating medium. Substrate 130 may be secured to the support mat 110. Substrate 140 (which may be provided in or trimmed to a desired design size) may be placed in a desired position over substrate 130, and secured to substrate 130 (e.g., with a suitable adhesive tape 150 positioned over and extending laterally beyond edges of substrate 140, etc.). The support mat 110 may then be prepared for use with (e.g., introduced into, etc.) the electronic cutting and/or drawing system 100.

With the tip 42 of the heating element 40 (FIG. 2) of the heat pen 10 heated to a desired temperature (e.g., a temperature suitable for laminating the laminating medium of substrate 140 to the substrate medium of substrate 130, etc.), any protective cover 120 (FIG. 9) shielding the tip 42 may be removed therefrom, and the electronic cutting and/or drawing system 100 may be used in a known manner (e.g., in accordance with its operating instructions under control of an appropriate scalable vector graphics (SVG or .svg) file, etc.) to cause a carriage 101 for the cradle 102 and, thus, the tip 42 of the heating element 40 of the heat pen 10 to contact the substrate 140 at selected locations. As the tip 42 of the heating element 40 contacts the substrate 140, laminating medium may be transferred from substrate 140 to substrate 130 to modify substrate 130 in a desired manner (e.g., with design features, such as text, a pattern, a design, an image, etc.), such as the modification 145 depicted by FIG. 11. Alternatively, the heat pen 10 may be used with an electronic cutting and/or drawing system 100 to directly modify a substrate 130, 140 (e.g., burn design features into a substrate (e.g., paper, cardstock, bookboard, vellum, leather, wood, etc.), melt design features into a substrate (e.g., vinyl, acetate, etc.), remove material from a substrate to define design features, etc.). The substrate(s) 130, 140 may then be removed from the support mat 110 (FIG. 10), and a protective cover may be placed over the tip 42 of the heating element 40 of the heat pen 10 and/or power to the heating element 40 may be shut off. The heat pen 10 may be disassembled from the cradle 102 of the electronic cutting and/or drawing system 10.

Although the foregoing description sets forth many specifics, these should not be construed as limiting the scope of any of the claims, but merely as providing illustrations of some embodiments and variations of elements or features of the disclosed subject matter. Other embodiments of the disclosed subject matter may be devised which do not depart from the spirit or scope of any of the claims. Features from different embodiments may be employed in combination. Accordingly, the scope of each claim is limited only by its plain language and the legal equivalents thereto.

What is claimed:

1. A method for laminating foil onto a sheet of media, comprising:

securing the sheet of media and a sheet of reactive foil in superimposed relation on a support mat of an electronic cutting and/or drawing system;

placing the support mat, the sheet of media, and the sheet of reactive foil beneath a carriage of the electronic cutting and/or drawing system;

selecting an adapter from a set of adapters useful with a plurality of different electronic cutting and/or drawing systems, the adapter adapting a heat pen to use with a cradle carried by the carriage of the electronic and/or drawing system; securing the adapter around at least a portion of the heat pen; securing the heat pen to the cradle;

heating a tip of a heating element of the heat pen; and operating the carriage of the electronic cutting and/or drawing system, including:

bringing the tip of the heating element into contact with the sheet of reactive foil; and moving the cradle and the heat pen over the sheet of reactive foil to transfer reactive foil from the sheet of reactive foil to the sheet of media in a desired manner;

removing the support mat from beneath the carriage of the electronic cutting and/or drawing system;

removing the sheet of reactive foil from the sheet of media; and removing the sheet of media from the support mat.

2. The method of claim 1, further comprising:

plugging the heat pen into a power source.

3. The method of claim 2, wherein plugging the heat pen into the power source comprises plugging a cable of the heat pen into a power supply port of the electronic cutting and/or drawing system.

4. The method of claim 1, further comprising:

securing a blade to the cradle; and before removing the support mat and removing the sheet of media, operating the carriage of the electronic cutting and/or drawing system, including:

bringing a tip of the blade into contact with the sheet of media; and moving the cradle and the blade over the sheet of media to cut the sheet of media in a desired manner.

5. The method of claim 1, wherein securing the adapter around at least the portion of the heat pen occurs before securing the heat pen to the cradle.

6. The method of claim 1, wherein securing the adapter around at least the portion of the heat pen comprises securing the adapter with an exterior having a shape that complements a shape of a receptacle of the cradle to enable the heat pen to be stably held by the receptacle of the cradle.

7. The method of claim 1, wherein operating the carriage comprises operating the carriage in accordance with instructions that correspond to one or more predetermined characters, patterns, and/or designs.

8. The method of claim 7, wherein operating the carriage includes:

accessing the instructions from memory of the electronic cutting and/or drawing system with a processor of the electronic cutting and/or drawing system; and executing the instructions with the processor, the processor:

bringing the tip of the heating element into contact with the sheet of reactive foil; and moving the cradle and the heat pen over the sheet of the sheet of reactive foil to transfer reactive foil from the sheet of reactive foil to the sheet of media in a desired manner.

9. The method of claim 8, wherein bringing the tip of the heating element into contact with the sheet of reactive foil comprises bringing the tip of the heating element into contact with at least one selected location of the sheet of reactive foil, as determined by the instructions.

10. The method of claim 7, wherein operating the carriage in accordance with instructions comprises operating the carriage in accordance with a scalable vector graphics file.

11. A method for using heat to define a design on a sheet of media, comprising:

securing the sheet of media to a support mat of an electronic cutting and/or drawing system;

introducing the sheet of media to a location adjacent to a carriage of the electronic cutting and/or drawing system;

selecting an adapter from a set of adapters useful with a plurality of different electronic cutting and/or drawing systems, the adapter adapting a heat pen to use with a cradle carried by the carriage of the electronic and/or drawing system; securing the adapter around at least a portion of the heat pen; securing the heat pen to the cradle;

heating a tip of a heating element of the heat pen; and operating the carriage of the electronic cutting and/or drawing system, including:

positioning the tip of the heating element at a desired location over the sheet of media;

moving the tip of the heating element toward the sheet of media; and moving the tip of the heating element over the sheet of media to form a design on the sheet of media in a desired manner.

12. The method of claim 11, further comprising:

removing the support mat from beneath the carriage of the electronic cutting and/or drawing system; and removing the sheet of media from the support mat.

13. The method of claim 11, wherein securing the adapter around at least the portion of the heat pen occurs before securing the heat pen to the cradle.

14. A method for using heat to define a design on a sheet of media, comprising:

positioning the sheet of media adjacent to a carriage of an electronic output device that provides a physical output under control of a vector graphics file to modify the sheet of media;

selecting an adapter from a set of adapters useful with a plurality of different electronic cutting and/or drawing systems, the adapter adapting a heat pen to use with a cradle carried by the carriage of the electronic output device;

securing the adapter around at least a portion of the heat pen;

assembling the adapter and the heat pen to the cradle;

heating a tip of a heating element of the heat pen; and operating the carriage of the electronic output device, including:

positioning the tip of the heating element at a desired location over the sheet of media;

moving the tip of the heating element toward the sheet of media; and moving the tip of the heating element over the sheet of media to form a design on the sheet of media in a desired manner.

15. The method of claim 14, wherein securing the adapter around at least the portion of the heat pen comprises securing an adapter with an exterior having a shape that complements a shape of a receptacle of the cradle to enable the heat pen to be stably held by the receptacle of the cradle.

* * * * *